US008500663B2

(12) United States Patent
Godfrey et al.

(10) Patent No.: US 8,500,663 B2
(45) Date of Patent: Aug. 6, 2013

(54) VIBRATING MASSAGE ROLLER UTILIZING A PLURALITY OF SUPPORTS AND ECCENTRIC WEIGHTS

(75) Inventors: Brian P. Godfrey, Salt Lake City, UT (US); Vince Warner, Alpine, UT (US)

(73) Assignee: Health e Company, Cottonwood Heights, UT (US)

( * ) Notice: Subject to any disclaimer, the term of this patent is extended or adjusted under 35 U.S.C. 154(b) by 655 days.

(21) Appl. No.: 12/614,304

(22) Filed: Nov. 6, 2009

(65) Prior Publication Data

US 2010/0113992 A1 May 6, 2010

Related U.S. Application Data

(60) Provisional application No. 61/111,961, filed on Nov. 6, 2008.

(51) Int. Cl.
*A61H 1/00* (2006.01)
*A61H 15/00* (2006.01)

(52) U.S. Cl.
USPC ..... 601/70; 601/46; 601/56; 601/57; 601/58; 601/60; 601/67; 601/69

(58) Field of Classification Search
USPC ..... 601/63, 91, 118, 119, 121, 52, 53, 601/122, 126, 56–60, 65, 67–72, 84–87, 601/112; 482/142, 148, 10
See application file for complete search history.

(56) References Cited

U.S. PATENT DOCUMENTS

| | | | | |
|---|---|---|---|---|
| 1,936,022 | A | 11/1933 | Hunt | |
| 2,425,655 | A * | 8/1947 | Tompkins | 601/57 |
| 2,466,470 | A | 4/1949 | Norris | |
| 2,539,712 | A * | 1/1951 | Wettlaufer | 601/57 |
| 2,604,091 | A | 7/1952 | Hansen | |
| 2,786,465 | A | 3/1957 | Moxley | |
| 2,904,036 | A | 9/1959 | Thomas | |
| 2,943,621 | A | 7/1960 | Phillips et al. | |
| 3,064,642 | A | 11/1962 | Stewart | |
| 3,322,116 | A | 5/1967 | Murphy et al. | |
| 3,363,623 | A * | 1/1968 | Atwell | 601/72 |
| 3,580,246 | A * | 5/1971 | Foreman | 601/72 |
| 3,896,795 | A * | 7/1975 | Solhkhah | 601/46 |
| 3,981,032 | A | 9/1976 | Brooks | |

(Continued)

FOREIGN PATENT DOCUMENTS

US WO 2004067364 8/2004

*Primary Examiner* — Justine Yu
*Assistant Examiner* — Christopher Miller
(74) *Attorney, Agent, or Firm* — Blue Filament Law PLLC; Avery N. Goldstein; Marc S. Balban

(57) ABSTRACT

The present invention is a vibrational roller utilizing a motorized vibrational drive using a plurality of eccentric weights and associated supports. The weights are positioned along the axis of rotation in a manner to synchronize them and minimize vibrational dissipation throughout the roller. Each weight has at least one associated support. The supports then transmit vibrational forces to the surface of the roller in an evenly distributed manner. A second co-operational motor may be used to extend motor life and aid in initiating vibrations. A control panel and associated circuitry are utilized to alter vibrational characteristics. The roller may be battery powered or powered through a standard wall outlet. The roller itself is manufactured of a durable yet deformable material, such as foam rubber, and may be inserted into selectable sleeves of varying physical properties for desired effect.

15 Claims, 4 Drawing Sheets

U.S. PATENT DOCUMENTS

| | | | | | |
|---|---|---|---|---|---|
| 4,081,870 | A | * | 4/1978 | Iannucci | 5/652 |
| 4,198,962 | A | | 4/1980 | McCauley | |
| 4,347,838 | A | | 9/1982 | McCauley | |
| 4,947,832 | A | * | 8/1990 | Blitzer | 601/56 |
| 5,007,410 | A | * | 4/1991 | DeLaney | 601/53 |
| 5,330,416 | A | | 7/1994 | Masuda et al. | |
| 5,374,238 | A | | 12/1994 | Xiao | |
| 5,393,287 | A | | 2/1995 | Papapaschalis | |
| 5,393,297 | A | * | 2/1995 | Kristoff | 601/57 |
| 5,471,103 | A | * | 11/1995 | Fujii | 310/81 |
| 5,554,102 | A | * | 9/1996 | Chiou | 601/72 |
| 5,824,013 | A | * | 10/1998 | Allen | 606/240 |
| 5,833,635 | A | | 11/1998 | Aboud, Sr. | |
| 6,056,357 | A | * | 5/2000 | Fukuoka | 297/217.3 |
| 6,203,470 | B1 | | 3/2001 | Lundin et al. | |
| 6,309,331 | B1 | | 10/2001 | Raymond | |
| 6,468,236 | B1 | * | 10/2002 | Sumanac | 601/49 |
| 6,505,361 | B1 | | 1/2003 | Ogawa | |
| 6,647,572 | B2 | | 11/2003 | Lee | |
| 6,702,766 | B2 | * | 3/2004 | Guitay | 601/6 |
| 7,087,004 | B1 | | 8/2006 | Berke | |
| 2003/0131414 | A1 | * | 7/2003 | Lee | 5/632 |
| 2004/0267173 | A1 | | 12/2004 | Mangano | |
| 2005/0033203 | A1 | * | 2/2005 | Son | 601/98 |
| 2005/0070827 | A1 | * | 3/2005 | Lee | 601/57 |
| 2006/0270954 | A1 | * | 11/2006 | Tumey | 601/70 |
| 2008/0200851 | A1 | * | 8/2008 | Faussett | 601/119 |
| 2008/0214969 | A1 | | 9/2008 | Milne et al. | |

* cited by examiner

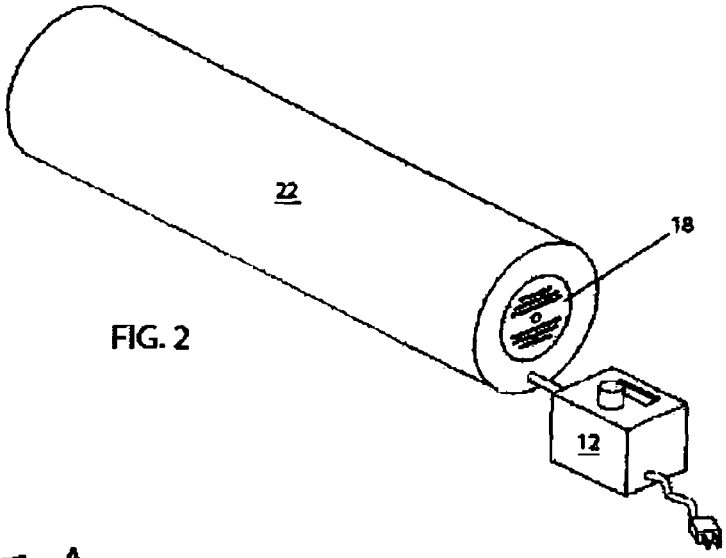
FIG. 2
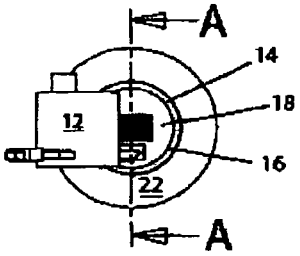
FIG. 3
FIG. 4
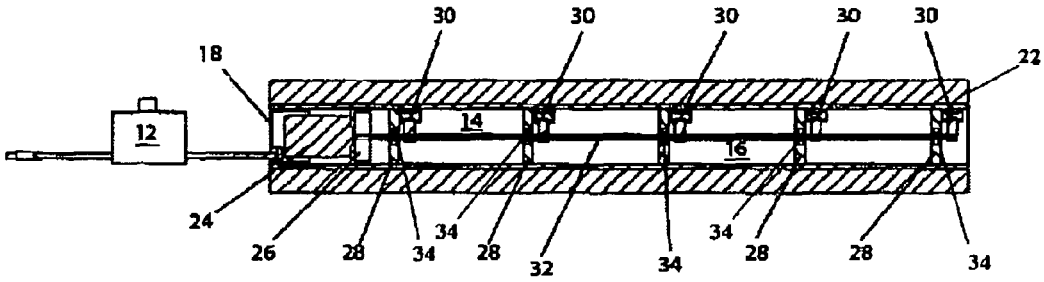

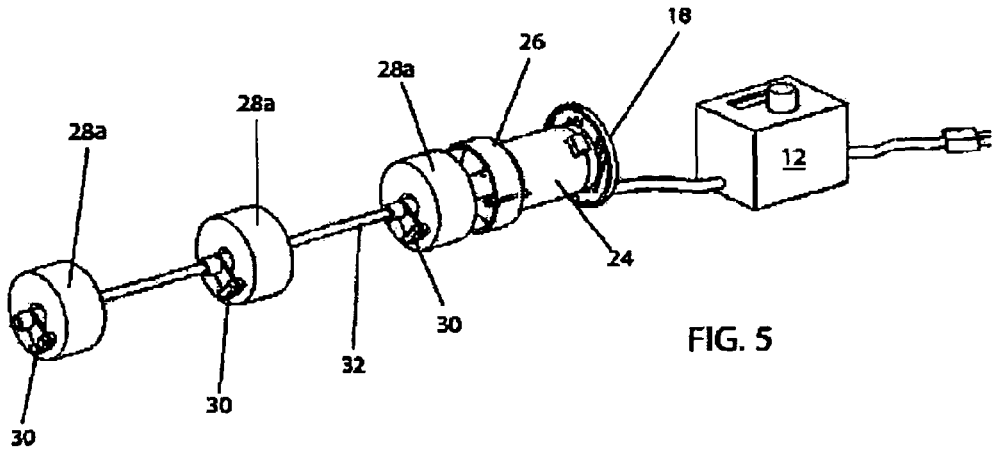
FIG. 5
FIG. 6
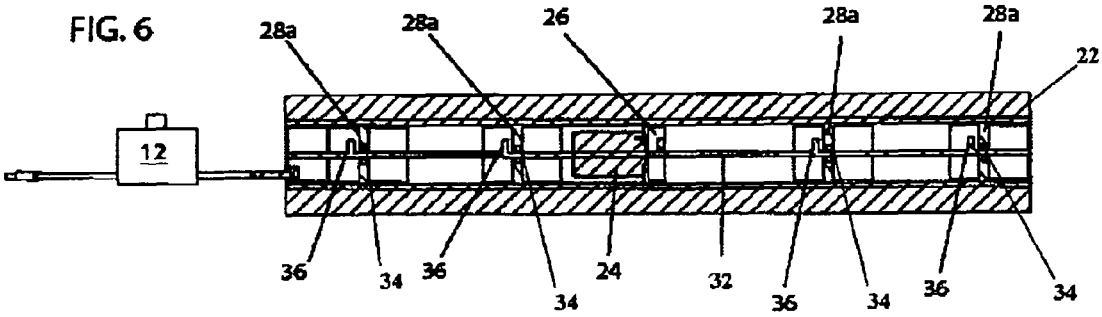

VIBRATING MASSAGE ROLLER UTILIZING A PLURALITY OF SUPPORTS AND ECCENTRIC WEIGHTS

CROSS-REFERENCES TO RELATED APPLICATIONS

The present Application claims priority as a non-provisional perfection of prior filed U.S. Provisional Application 61/111,961, filed Nov. 6, 2008 and incorporates the same by reference herein it its entirety.

FIELD OF THE INVENTION

The present invention relates to the field of massagers and more particularly relates to a massage roller that utilizes a plurality of eccentric weights rotating at different points along the same axis throughout the length of the roller and an associated plurality of vibrational transmission supports.

BACKGROUND OF THE INVENTION

Massage is the manipulation of a person's muscles in order to effect a release of muscular tension. It involves many strategies, including kneading and stretching muscles, percussive striking, and vibration. Massage is well known in the fields of medicine, chiropractic, physical therapy and kinesiotherapy. In fact, massage is its own field of practice, requiring study and, in most cases in the US, certification. It is practiced universally around the globe, both professionally and personally, and is recognized as providing some benefits to the emotional and physical health of those receiving it.

In light of the almost universal appeal and recognition of massage, many different styles of massage have been developed, ranging from Shiatsu, Swedish, Deep Tissue, and others, and tools to aid in massage have developed in each discipline. One such tool is known as a massage "roller." Rollers are cylindrical or semi-cylindrical bodies made of a compliant material, such as foam, which are used in exercise, massage and therapy and other disciplines. Rollers are used for stretching soft tissues, increasing circulation, reducing tension and stress from the soft tissues, improving posture and alignment, increase spinal mobility. Core and corrective exercises can be used with the roller as well.

The present invention is a roller with an internal vibrator so as to aid in massage. While such devices are known in the prior art, they all suffer from a serious drawback answered in the present invention. The drawback is that such vibrating rollers are constructed with a motor and eccentric weight system along the cylindrical axis. However, the positioning of the eccentric weight is key for such systems as there will be stronger vibrations proximate the weight and weaker vibrations further form it. So if the weight is at one end of the roller, vibrations will dissipate as they travel the length of the roller. If the weight is centrally located, vibrations will still dissipate as they travel towards the edges. This is especially noticeable on longer rollers.

One solution is to utilize a plurality of spaced motors, utilized in U.S. Pat. No. 6,647,572 (2003). In this case, while vibrations may be more evenly distributed, it is dependent upon a plurality of individual motors which may malfunction or, simply, break. This is problematic if the motor is inaccessible for repair, especially when the motors are totally encased in a support material.

Prior art solutions that use eccentric weights rotating about an axle fail to evenly distribute vibrations to a roller or other massager surface as they generally have only two contact points, one at the motor and one at or by a terminal end of the axle. This localizes all vibrational transmission at those two end points and can cause "weak spots" or "dead zones" along the length of a massager apparatus, especially if they are improperly spaced and allow destructive interference between the two points of contact. Improper placement of a plurality of motors can likewise create this effect.

The present invention represents a departure from the prior art in that the massaging roller of the present invention allows for even distribution of vibrations by utilizing a plurality of eccentric weights and supports that are positioned at different points along a shaft parallel to the axis of the cylinder and are synchronized and positioned for maximum vibrational efficiency. By utilizing a plurality of eccentric weights and strategically placed supports, the vibrations engage in reinforcing behavior as they travel the length of the roller, which keeps vibrations uniform throughout the roller, even in a longer one. By using one motor and one axle, there are fewer parts and less chance of malfunction and easier to replace or fix when malfunction does occur. Two synchronized, cooperating motors may be used in an alternate embodiment of the invention, but this is not preferred for reasons stated above.

SUMMARY OF THE INVENTION

In view of the foregoing disadvantages inherent in the known types of massagers, this invention provides a more efficient vibrational roller. As such, the present invention's general purpose is to provide a new and improved vibrational roller that utilizes a more efficient drive mechanism which limits dissipation of vibrational waves as a function of distance from the eccentric weight imparting the vibration.

To accomplish these objectives, the vibrational roller comprises a motor with an axle extending cantileverally therefrom with a plurality of eccentrically positioned weights and a plurality of supports that are so positioned that they are of different distances from the motor. Two cooperative motors may be positioned so as to both operate the axle. The motors are controllable to selectively alter vibrational characteristics, such as frequency and amplitude. The weights are positioned and synchronized to maximize efficiency and minimize vibrational attrition. In use, the roller also comprises a durable casing with a deformable outer shell (permanent padding) and utilizes selectable padded covers, into which the roller may be inserted so as to vary resistance, pressure, texture, vibrational transmission, and other factors.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIG. 2 is a perspective view of the massage roller of FIG. 1, with an optional covering sleeve.

FIG. 3 is a front elevation of the massage roller of FIG. 2.

FIG. 4 is a sectional view of the massage roller of FIG. 3, taken along line A-A.

FIG. 5 is a perspective view of the internal structure of a massage roller according to an alternate embodiment of the invention.

FIG. 6 is a sectional view of a massage roller according to a still further embodiment, along the same line as FIG. 4.

DETAILED DESCRIPTION OF THE PREFERRED EMBODIMENT

Figure 1:
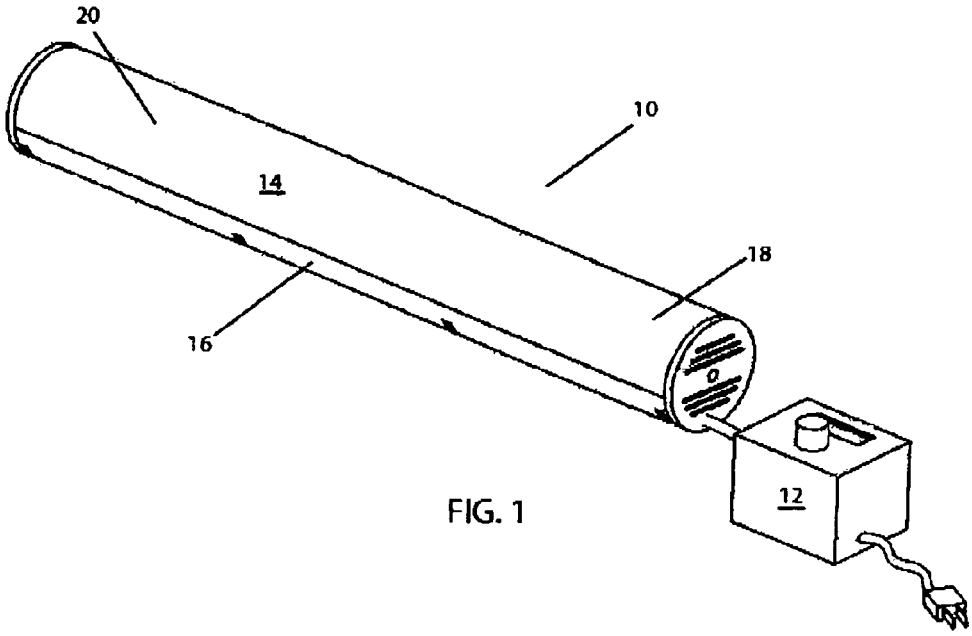
FIG. 1 is a perspective view of a massage roller according to one embodiment of the invention.

With reference now to the drawing, the preferred embodiment of the vibrational roller is herein described. It should be noted that the articles "a", "an", and "the", as used in this specification, include plural referents unless the content clearly dictates otherwise.

In its basic construction, shown in FIGS. 1-6, the vibrational roller 10 comprises a tubular casing 14, 16 with a hollow center. Resident inside the center, is a shaft (or "axle") 32 mounted between a thrust bearing 26 and a motor 24. A coupling may be used to couple the shaft 32 to the motor 24 or the shaft 32 may connect directly to the motor 24 as shown in the figures. Supports 28 are provided to provide linkage between the casing 14, 16 and the shaft 32. Bearings 34 provide a rolling surface, and thus reduced friction, to the shaft 32. A plurality of eccentric weights 30 are positioned along the shaft 32. These weights 30 are each a different length from the motor 24, or from a chosen reference point that is on the shaft 32. The weights 30 are eccentrically mounted, meaning that their center of mass is not positioned on the shaft 32 itself, but rather some distance, x, away from the axis of rotation. Thus, when the shaft 32 rotates along its axis, the weights 30 describe a circular motion about the axis and impart a wobble to the shaft 32. This wobble is transmitted 5 to the casing 14, 16 through the supports 28. When sufficient RPMs are reached, the wobble causes a strong vibration transmitted throughout the casing 14, 16. The weights 30 and supports 28 are strategically positioned about the shaft 32 so as to provide maximum synchronous and uniform vibration advantage during rotation, which is to say they are positioned in a manner to provide a uniform vibrational profile throughout the shaft 32 and entire roller 10. The positioning of the supports is of paramount importance as these structures actually impart the uniform vibrational profile to the surface of the roller. As such, the plurality of supports is actually more important to the vibrational profile than is the plurality of weights. Through proper positioning of these supports, vibrations at the surface of the roller will have uniform strength along the length of the roller, with no "dead" or "weak" spots where vibration is not present due to destructive wave interference.

Control of the motor 24, and thus the vibration, is achieved through control unit 12, which may be a separate unit as shown in the figures or positioned on the forward end cap 18, which seals one end of the roller 10. The other end is sealed by a second end cap 20. Control unit 12 may have different switches to alter the vibrational characteristics by adjusting the rotational characteristics of the motor 24. Communication of changes may be displayed on an LCD screen.

Figure 7:
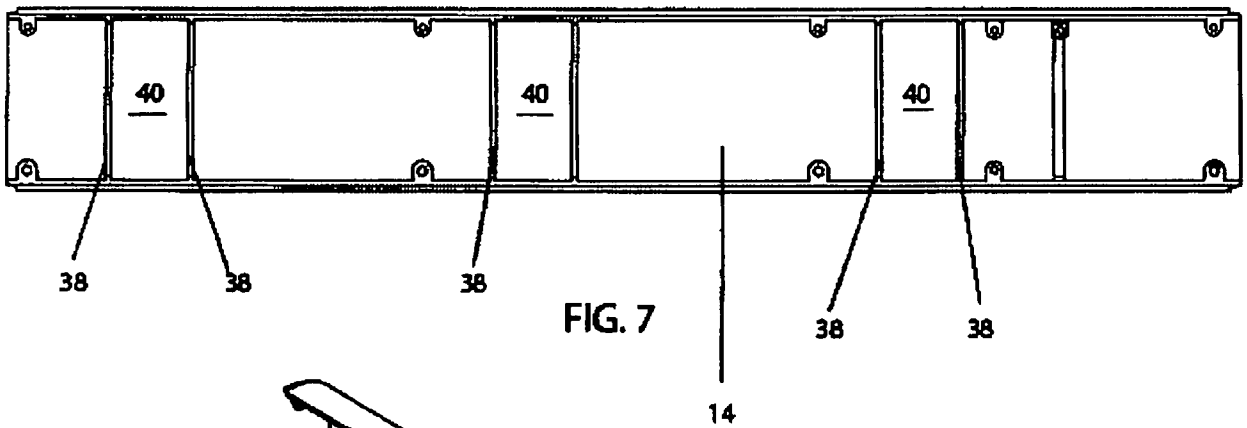
FIG. 7 is an elevation of half of a casing used in the present invention.
Figure 8:
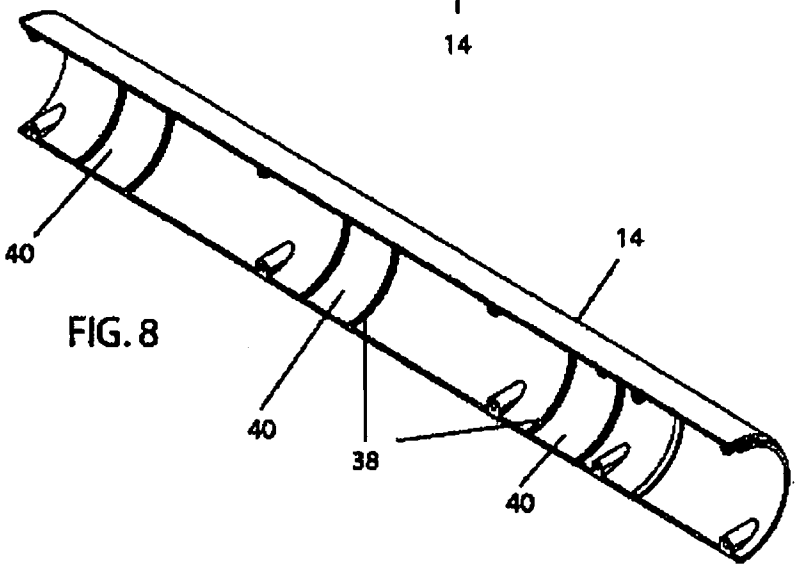
FIG. 8 is a perspective view of the half of casing of FIG. 7.

A number of alternative embodiments are possible. The first alternative embodiment would be to utilize a pair of cooperative motors, one located on either end of the shaft 32. The control unit 12 could then activate one or both motors simultaneously or alternatively in a manner to lessen wear on each motor individually, thus prolonging motor life. Multiple motors could be used, each with different shafts and different sets of weights. The roller may be made in various sizes. Length may vary from 12 to 36 inches and circumference may vary from 3 to 10 inches. The roller should be able to resist up to 350 pounds of pressure. As shown in FIG. 5, the broad **28*a* are broader than supports 28 as depicted in FIG. 4. Weights may be separate pieces 30 or may be a weighted portion 36 integral with the shaft 32, shown in FIG. 6. Another alternative would be to have a number of shafts, each of different length, extending from the same motor and having one or more eccentric weights mounted thereon. Ideally these would be along the same axis and then could even be a single axle passing through the motor 24 as shown in FIG. 6. Separate axles may be used which have different axes, and positioning them and weights about them for maximum effect, namely the even distribution of vibrations to the surface of the roller, would be a mathematical calculation that could be ascertained with not much difficulty and would involve the length and mass of the axle and roller as whole, moment of inertia of the axle and weights, rotational frequency and other factors. FIGS. 7 and 8 illustrate an interior surface of the roller casing (which is ideally PVC plastic or some other durable material). Detents 40 are provided to secure supports 28 within the casing 14 (and similarly on the other half of the casing 16 which is not shown as it is redundant). Detents could be grooves formed within the casing or may each be a pair of ribs 38, as depicted, or any other similar structure. The detents 40 provide a more positive interaction of the supports 28 with the casing, when assembled. This increases efficiency of vibrational transmission and helps secure the supports in their intended position along the axle 32**.

In use, about the casing 14, 16 is an exterior sleeve 22 (FIG. 2) made of a durable, yet deformable material, such as foam rubber so as to impart a pleasing surface which will efficiently and effectively transmit vibrations and to provide impact resistance, sound dampening, and electromagnetic insulation. An effective layer of such material should be between 1 and 2 inches thick, depending upon the size of the roller and internal vibrational motor. The roller may be inserted in padded sleeves of varying textures, density and softness for desired effect on vibration or sensation. Sleeve thickness will be between 1 and 3 inches, depending upon desired effect and materials. This will then impart 2 to 6 inches to the diameter of the roller. The use of sleeves is preferable as the sleeves may be made to be washable, an important feature in clinical use, and can provide protection of the roller unit from elements and wear and tear. Individual sleeves may also be provided for varying textures, support, firmness and also can be used to provide thermal variation for therapeutic use.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A massage roller comprising:

a motor;

a central axle projecting from said motor;

a plurality of eccentric weights, positioned at different points along said central axle;

a plurality of axle supports surrounding said axle and positioned along said axle, each of said plurality of axle supports having a bearing around said central axle;

tubular casing formed of complimentary casing portions, said tubular casing containing said motor and vibrationally linked to said axle by said plurality of axle supports, said plurality of axle supports are in circumferential contact with said tubular casing;

a power supply for said motor; and wherein each of said plurality of eccentric weights is distal to said motor with respect to an adjacent axle support from said plurality of axle supports.

2. The massage roller of claim 1, wherein the tubular casing is formed from a polyvinyl chloride (PVC) plastic material.

3. The massage roller of claim 1, further comprising an outer sleeve formed with a deformable material capable of encompassing the tubular casing of the massage roller.

4. The massage roller of claim 1, further comprising a plurality of ribs along an interior of said tubular casing such that at least one of said plurality of axle supports resides between two adjacent ribs of said plurality of ribs.

5. A massage roller comprising:

a motor;

a central axle projecting from said motor;

a plurality of eccentric weights, positioned at different points along said central axle;

a plurality of axle supports surrounding said axle and positioned along said axle, each of said plurality of axle supports having a bearing around said central axle;

a tubular casing, containing said motor and vibrationally linked to said axle by said plurality of axle supports, said plurality of axle supports are in circumferential contact with said tubular casing;

a control unit with different switches to alter the vibrational characteristics of said massage roller by adjusting the rotational characteristics of said motor;

a power supply for said motor; and wherein each of said plurality of eccentric weights is distal to said motor with respect to an adjacent axle support from said plurality of axle supports.

6. The massage roller of claim 5, wherein the tubular casing is formed from a polyvinyl chloride (PVC) plastic material.

7. The massage roller of claim 5, further comprising an outer sleeve formed with a deformable material capable of encompassing the tubular casing of the massage roller.

8. The massage roller of claim 5, further comprising a plurality of ribs along an interior of said tubular casing such that at least one of said plurality of axle supports resides between two adjacent ribs of said plurality of ribs.

9. The message roller of claim 3, wherein said outer sleeve is formed with foam rubber.

10. The message roller of claim 3, wherein said outer sleeve has a thickness of between 1 and 3 inches.

11. The message roller of claim 5, wherein said control unit is a separate unit from said message roller or positioned on a forward end cap, said forward end cap sealing one end of said tubular casing.

12. The message roller of claim 5, wherein said outer sleeve is formed with foam rubber.

13. The message roller of claim 5, wherein said outer sleeve has a thickness of between 1 and 3 inches.

14. The massage roller of claim 1 wherein said central axle has two portions, each of the two portions extending from opposite sides of said motor along a common axis and each of the two portions having at least one eccentric weight positioned thereon.

15. The massage roller of claim 1, wherein said power supply is in circumferential contact with said tubular casing.

* * * * *